US007913874B2

(12) United States Patent
Gruskin et al.

(10) Patent No.: US 7,913,874 B2
(45) Date of Patent: Mar. 29, 2011

(54) PLASTIC COFFEE CONTAINER WITH HANDLE

(75) Inventors: Glenn S. Gruskin, Nanuet, NY (US); Jiayan Gu, Nanuet, NY (US); John A. Blake, Danbury, CT (US); Leonard S. Scarola, Basking Ridge, NJ (US); George T. Albright, Rutherford, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 784 days.

(21) Appl. No.: 11/353,091

(22) Filed: Feb. 14, 2006

(65) Prior Publication Data

US 2007/0187420 A1 Aug. 16, 2007

(51) Int. Cl.

| | |
|---|---|
| ***B65D 25/10*** | (2006.01) |
| ***B65D 81/24*** | (2006.01) |
| ***B65D 51/16*** | (2006.01) |
| ***B65D 41/04*** | (2006.01) |
| ***B65D 53/00*** | (2006.01) |
| ***B65D 90/02*** | (2006.01) |
| ***B65D 23/10*** | (2006.01) |

(52) U.S. Cl. ..... 220/771; 220/203.1; 220/367.1; 220/288; 220/304; 215/384; 215/398

(58) Field of Classification Search ..... 220/771, 220/202, 203.01, 203.29, 770; 215/384
See application file for complete search history.

(56) References Cited

U.S. PATENT DOCUMENTS

| | | | | |
|---|---|---|---|---|
| D276,890 | S | 12/1984 | Hancher | |
| D321,624 | S | 11/1991 | Fiore et al. | |
| 5,269,438 | A * | 12/1993 | Kelsey | 220/766 |
| 5,320,231 | A * | 6/1994 | Iodice | 215/385 |
| 5,350,078 | A * | 9/1994 | Potts et al. | 215/384 |
| D352,459 | S | 11/1994 | Pollacco | |
| D358,333 | S | 5/1995 | Stockwell et al. | |
| D360,830 | S | 8/1995 | Hestehave et al. | |
| 5,472,105 | A * | 12/1995 | Krishnakumar et al. | 215/384 |
| D376,761 | S | 12/1996 | Lathrop et al. | |
| D401,154 | S | 11/1998 | Robinson | |
| D403,578 | S | 1/1999 | Paul et al. | |
| D417,849 | S | 12/1999 | Beaver | |

(Continued)

OTHER PUBLICATIONS

Hills Bros. "Original Blend Easy-Grip Handle"—photos, red coffee container with black top.

(Continued)

*Primary Examiner* — Anthony Stashick
*Assistant Examiner* — Andrew T Kirsch
(74) *Attorney, Agent, or Firm* — Stites & Harbison PLLC; Marvin Petry; Douglas E. Jackson

(57) ABSTRACT

A plastic container for a particulate product has a footprint and includes a base and at least two and preferably four sides upstanding therefrom which generally define a container main interior volume. A top connects to the sides and includes a large opening which is closed by a lid. One side includes a pass-through handle located therein having a generally vertical segment which may define a hollow cavity in communication with the main interior volume. The opening of the top is sufficiently large to extend over a portion of the hollow cavity; or is sufficiently wide to receive about a 5" diameter cylinder therethrough, and has a ratio of a minimum span to a bottom diagonal of at least about 2:3. A shoulder between the top and sides has an angle of less than about 40°. The handle is configured and sized for easy grasping and holding.

21 Claims, 20 Drawing Sheets

U.S. PATENT DOCUMENTS

| | | | | |
|---|---|---|---|---|
| D422,920 | S | 4/2000 | Tapp et al. | |
| D430,033 | S | 8/2000 | Beaver et al. | |
| D448,671 | S | 10/2001 | Gans et al. | |
| D474,114 | S | 5/2003 | Vlahakis et al. | |
| 6,854,617 | B2 | 2/2005 | Taylor et al. | |
| 2002/0195471 | A1* | 12/2002 | Nottingham et al. | 222/570 |
| 2003/0010787 | A1* | 1/2003 | Dalton et al. | 220/912 |
| 2004/0164048 | A1* | 8/2004 | Yourist | 215/398 |
| 2004/0182863 | A1* | 9/2004 | Taylor et al. | 220/288 |

OTHER PUBLICATIONS

Café Terra "Guatemalan Breakfast Blend"—photographs of a clear container with a white top.

* cited by examiner

PLASTIC COFFEE CONTAINER WITH HANDLE

RELATED APPLICATIONS

This application has subject matter similar to application Ser. No. 11/353,092 and application Ser. No. 11/353,093, filed concurrently herewith and by the same inventors; which applications are hereby incorporated by reference.

BACKGROUND OF THE INVENTION

Containers for particulate (roast or ground) coffee have many unique requirements not considered for other containers. For example, coffee particulates give off gases while being stored, and are deleteriously affected by air. Thus, coffee particulate containers must prevent the ingress of air and hence be air-tight; but such containers must also be suitably robust to withstand a build-up of pressure, or alternatively, the container must vent the built up gases before the pressure thereof damages (miss-shapes or breaks) the container.

While particulate coffee containers were previously generally made of metal (which was easily made robust and air-tight), new plastic containers, particularly with layered walls, have now been found to be suitable for containing particulate coffee. However, such plastic containers have been difficult to handle, especially where they are of sufficient size to store a desired volume of particulate coffee, typically in the range of 2-4 pounds. Ease of use by the user of such plastic containers at home has also been a problem.

Plastic coffee containers have been known with pinch handles. However, such pinch handles require significant friction to be generated by the thumb/fingers of the user to prevent slippage, which friction is the result of the force with which the thumb/fingers engage the pinch handle. Thus, such pinch handles are difficult for the user to hold and to hold with the required force for a sufficient time due to tiring, so that the overall container weight which a user is able to hold is limited. In addition, as the container is supported against slippage by thumb/fingers engaging the pinch handle, this produces a moment on the wrist which produces strain to the wrist and which may also add to the difficulty of holding the container and the tiring of the hand of the user, and which adds to the difficulty of holding on to the pinch handle itself. Thus, from an ergonomics viewpoint, pinch handles have significant disadvantages.

BRIEF SUMMARY OF THE INVENTION

In accordance with the present invention, a plastic container for a particulate product, which product is removed by hand therefrom, includes a base and respective at least two sides and preferably at least first, second, third and fourth sides upstanding from the base. The base and the two or more sides generally define a container main interior volume, and generally form a footprint for the container which is in some embodiments generally rectangular or more preferably square. A top includes a large opening therein which is closed by a lid. One side includes a pass-through handle located in that side and preferably midway horizontally therealong. The pass-through handle may include a generally vertical segment which may include a hollow cavity in a preferred embodiment which is in communication with the main interior volume. The opening of the top is sufficiently large so that it extends over a portion of the vertical segment or hollow cavity therein.

In a preferred embodiment, the opening is centered on the footprint. In addition, the hollow cavity has a top end and a bottom end, both of which are in communication with the main interior volume.

Further in a preferred embodiment, the top opening is sufficiently wide to receive about a 5" diameter cylinder therethrough to assure that a user's hand will also fit therethrough. Additionally, the top opening preferably has a ratio of a minimum span to a bottom diagonal of at least about 2:3.

In accordance with a preferred embodiment, the handle has a vertical length of at least about 2.5" and a width to thickness ratio of about 1.0 to 1.2. In addition, the hollow cavity of the handle tapers slightly inward from the bottom to the top, which taper is preferably about 3°.

In one embodiment, the sides are generally connected to the top by a shoulder whose angle to vertical at a maximum thereof is less than about 400. This connection may also include a circular collar at an angle and beads above the shoulder. In addition, the one side at a location above the handle preferably includes a thumb receiving concavity. If desired, the vertical segment can include vertically spaced concavities forming finger grips on an inwardly directed part thereof.

In another preferred embodiment, two of the sides include label receiving areas indented from a remainder of the respective side. In addition, the sides may include vertical ribs and/or horizontal ribs.

In a further preferred embodiment, the side with the handle is generally outwardly extended or peaked horizontally away from the two adjacent sides thereof. This outwardly extended side includes upper left and right transition portions from a top of the handle laterally to the respective adjacent sides, which upper transition portions are generally vertical and flat. The outwardly extended side also includes lower left and right transition portions from a bottom of the handle laterally to the respective adjacent sides, which lower transition portions are generally vertical and concave.

In still another preferred embodiment, the sides are connected to one another by short bevel transition portions, so that where there are four main sides there are in effect eight total sides though the footprint is still generally rectangular.

In yet another preferred embodiment, the container has only a flat side and an arcuate side. With this embodiment, the handle can be located in either side.

It is an advantage of the present invention that a plastic container from which a particulate product is withdrawn includes a handle which is easily grasped and held.

It is also an advantage of the present invention that the container has a wide opening permitting easy access thereto by the user in order to withdraw the product therefrom, especially when the container is almost empty.

It is a further advantage that the container has sufficient shoulder strength to withstand stacking and/or loading without damage.

Other features and advantages of the present invention are stated in or apparent from detailed descriptions of presently preferred embodiments of the invention as discussed in greater detail below.

DETAILED DESCRIPTION OF THE INVENTION

With reference now to the drawings in which like numerals represent like elements throughout the views, a first embodiment of a plastic particulate coffee container 10 is shown in FIGS. 1-6. It will be appreciated that container 10 is designed for the containing of ground or roast (particulate) coffee 11 or a like non liquid-like product, so that container 10 is made of a suitable blow-molded plastic such as high density polyethylene, preferably by an extrusion blow molding rotary process. Typically, as known in the art, such a plastic material is provided as different polymeric layers including an $O_2$ barrier layer. As known in the art, when an excess pressure of off gases generated by particulate coffee 11 is present, a suitable vent is provided at some convenient location to release this excess pressure, as discussed subsequently hereafter. It will also be appreciated that particulate coffee 11 is typically not poured by the user, so pouring of particulate coffee 11 from container 10 is not likely. Rather, particulate coffee 11 will be removed from container 10 by a user with a scoop, spoon, or the like.

Figure 3:
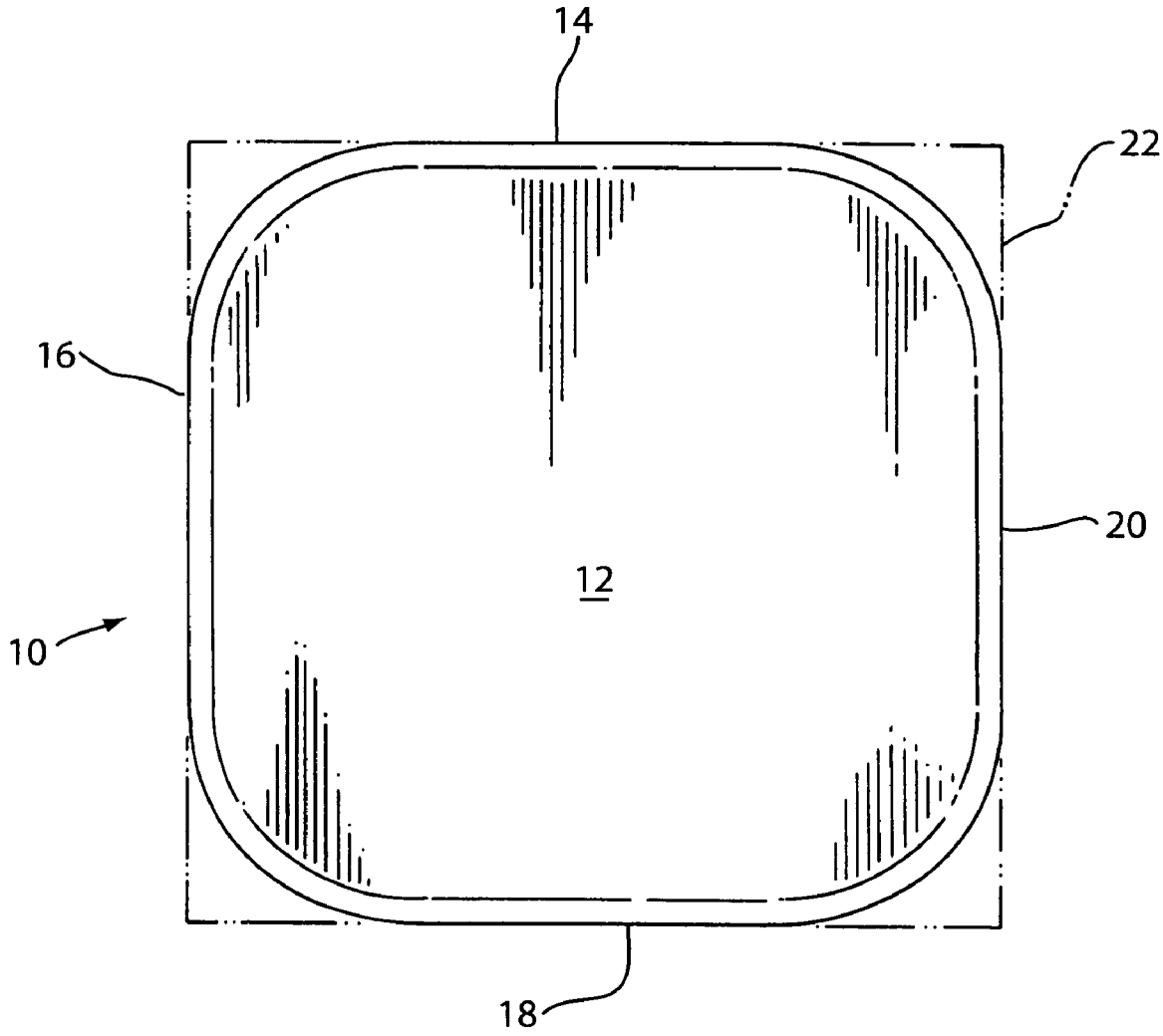
FIG. 3 is a bottom plan view of FIG. 1.
Figure 4:
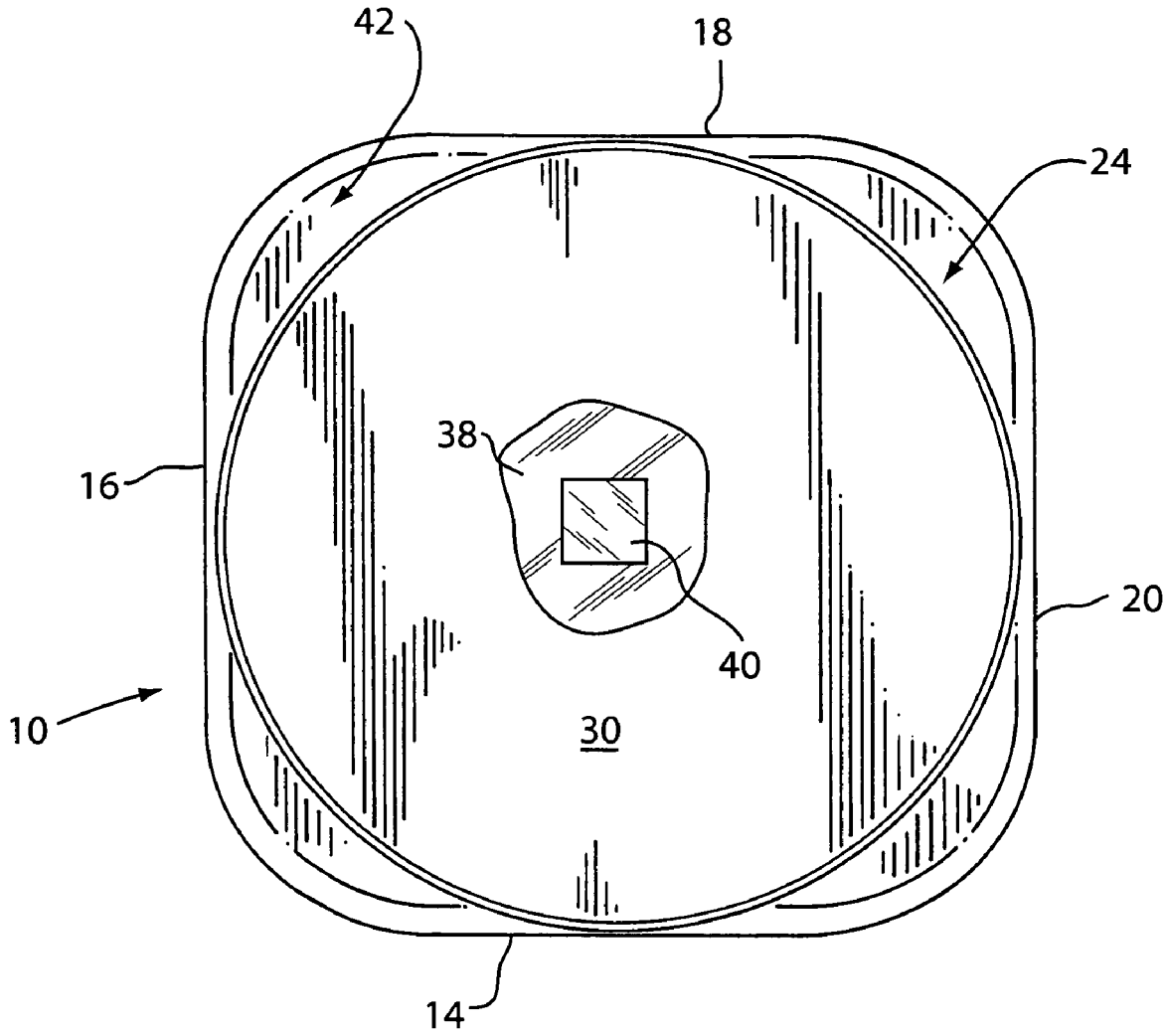
FIG. 4 is a top plan view of FIG. 1.
Figure 5:
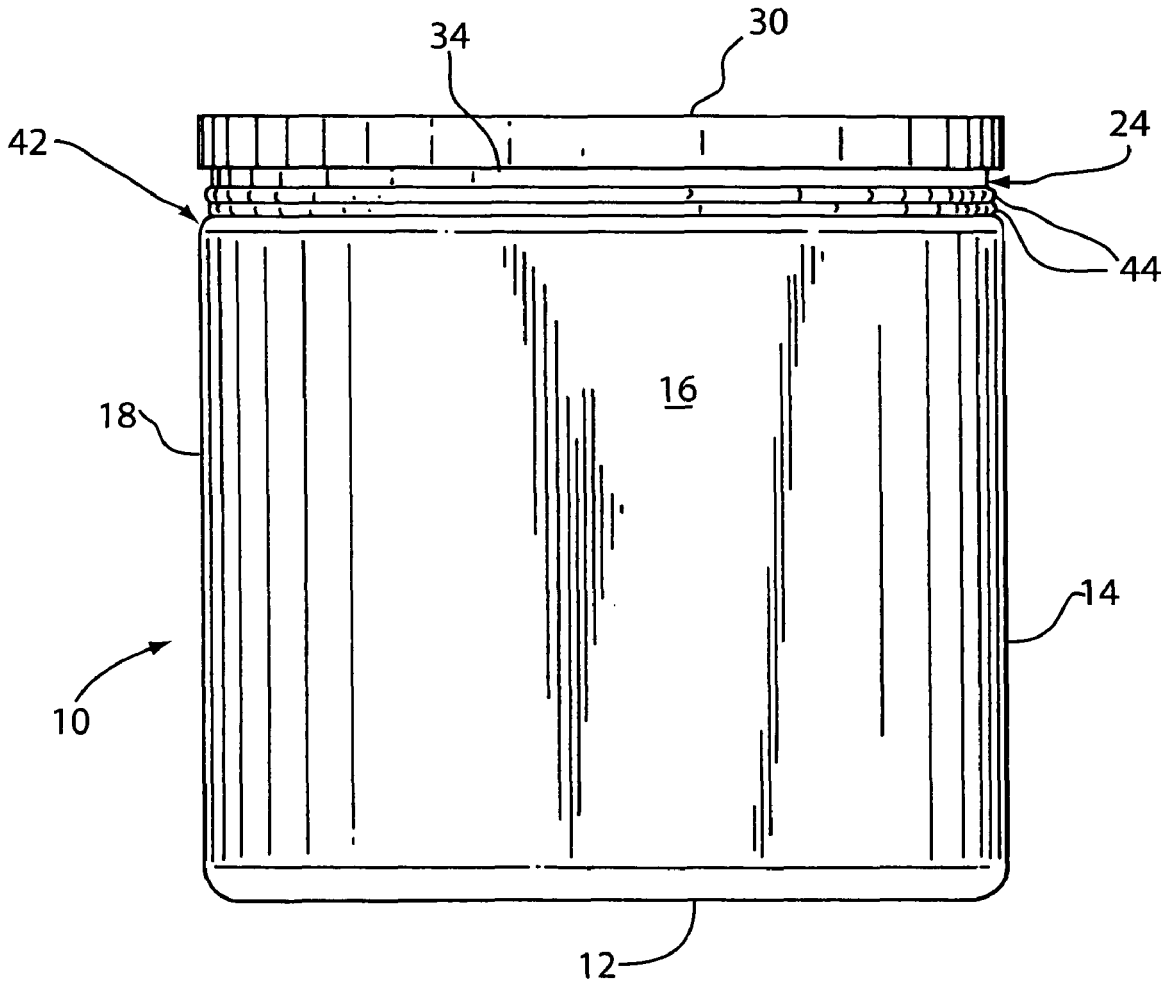
FIG. 5 is an elevation view taken in the direction of arrow B of FIG. 1.

In general, it will be appreciated that container 10 includes a generally square base 12 with a front side 14, a left side 16, a back side 18 and a right side 20 extending upwardly therefrom. The designations of "front", "left", etc. are arbitrarily chosen for convenience of description, and are not to be considered as limiting the description or the claimed invention as terms such as "first", "second" etc. may as easily be used instead. The transition intersections of base 12 and sides 14, 16, 18 and 20 are curved as shown for strength in this embodiment. However it will be appreciated that the general footprint 22 of container 10 is rectangular, and with the sides of equal width is actually square as shown in FIG. 3 for this embodiment; so that when container 10 is maximally packaged or displayed with other containers 10 in a compact arrangement, each container is located in a square footprint. It will also be appreciated that the generally square (or rectangular) footprint also means that container 10 will not roll when it is accidentally tipped over onto a side as would occur with a cylindrical container.

Container 10 also includes a top 24 including a circular rim 34 connected to sides 14, 16, 18 and 20 so that container 10 defines a main interior volume 26 in which particulate coffee 11 is retained. Provided in top 24 defined by rim 34 is a large opening 28. Rim 34 and opening 28 are circular in this embodiment, but either could be another shape such as oval or square, so long as opening 28 is sufficiently large to permit a hand of a consumer to pass therethrough and scoop particulate coffee 11 from container 10. The size of opening 28 is especially important when the user is trying to scoop the remaining particulate coffee 11 from the bottom of container 10, as the large opening 28 makes it easier to pass more of the user's hand therethrough in order to easily reach particulate coffee 11 resting on base 12. An opening having a main length dimension of about at least 4.5 inches and a main lateral dimension of about at least 3.5 inches is sufficient for this purpose. However, it has been found that a minimum preferred effective size for opening 28 where opening 28 is round is a 5" diameter—though if the opening were not circular, the minimum effective preferred size would be that which would (similarly) pass a cylinder 5" in diameter. In addition, a ratio of a minimum opening span of opening 28 (which is the diameter in this embodiment) to a bottom diagonal of square (or rectangular, or other polygon) base 12 is at least 2:3, and preferably about 3:4. As shown best in FIG. 4, opening 28 is preferably centered in footprint 22.

Covering opening 28 is a plastic lid or covering 30. Lid 30 is preferably removably (snap-on) held on rim 34 of top 24 as typical in the container art. In this embodiment, the removability of lid 30 is provided by use of an outside bead 32 extending laterally about the uppermost part of rim 34 and a corresponding flange 36 extending laterally inward from a bottommost part of lid 30. As shown, flange 36 is received and held underneath bead 32 when lid 30 is removably attached to rim 34. It will be appreciated that the resiliency of lid 30 permits lid 30 to be removed from top 24 easily by a user, and that while lid 30 does serve to generally seal particulate coffee 11 from atmosphere, this is not an air-tight seal. Alternatively, a screw-on lid or the like could be used to more securely cover opening 28 of top 24 and to better seal main interior volume 26.

Prior to use—that is after manufacture/filling, during shipping and storage, and before being opened for use by a consumer—opening 28 is covered by a peelable sheet (including foil, plastic or layered foil/plastic) 38 which maintains an air-tight seal over opening 28. Sheet 38 is very thin and hence is depicted schematically by a broken line. In this preferred embodiment, sheet 38 also carries a one-way vent 40 (also schematically depicted) which permits pressurized off-gases generated in container 10 to be vented therefrom when the pressure in container 10 reaches a predetermined value. Once vented from container 10, the off-gases pass to atmosphere along small grooves (not shown) provided in lid 30 adjacent bead 32 so that the seal of lid 30 to top 24 is not air-tight as noted above. Suitable vents for use as vent 40 are known in the art (see, e.g., U.S. Pat. No. 5,688,544 and U.S. Pat. No. 6,662,827) and thus need not be discussed further; and it will be appreciated that vents at other locations such as on a side are also known and could be used if desired.

Figure 1:
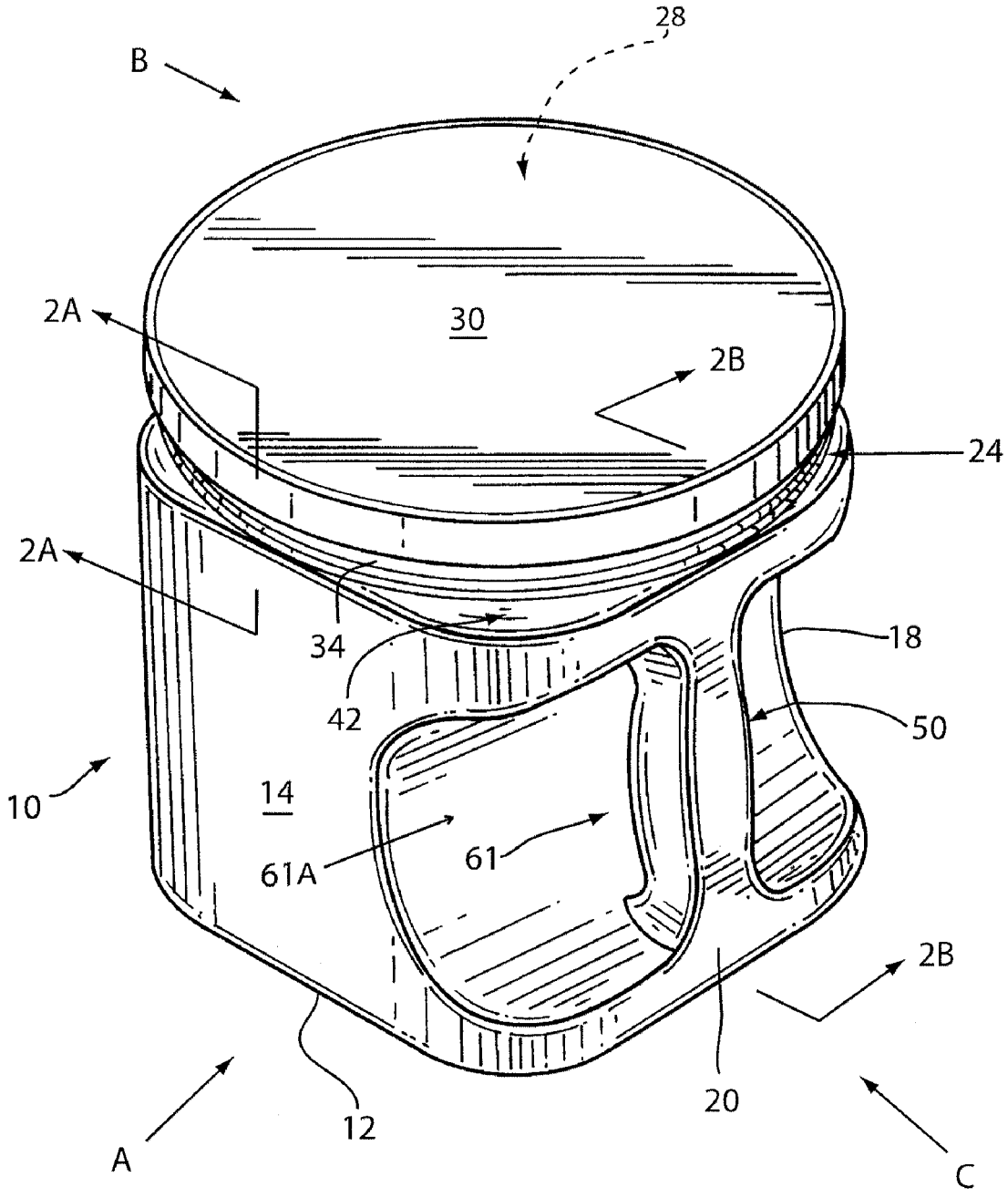
FIG. 1 is a perspective view of a first embodiment of a particulate coffee container of the present invention.
Figure 2:
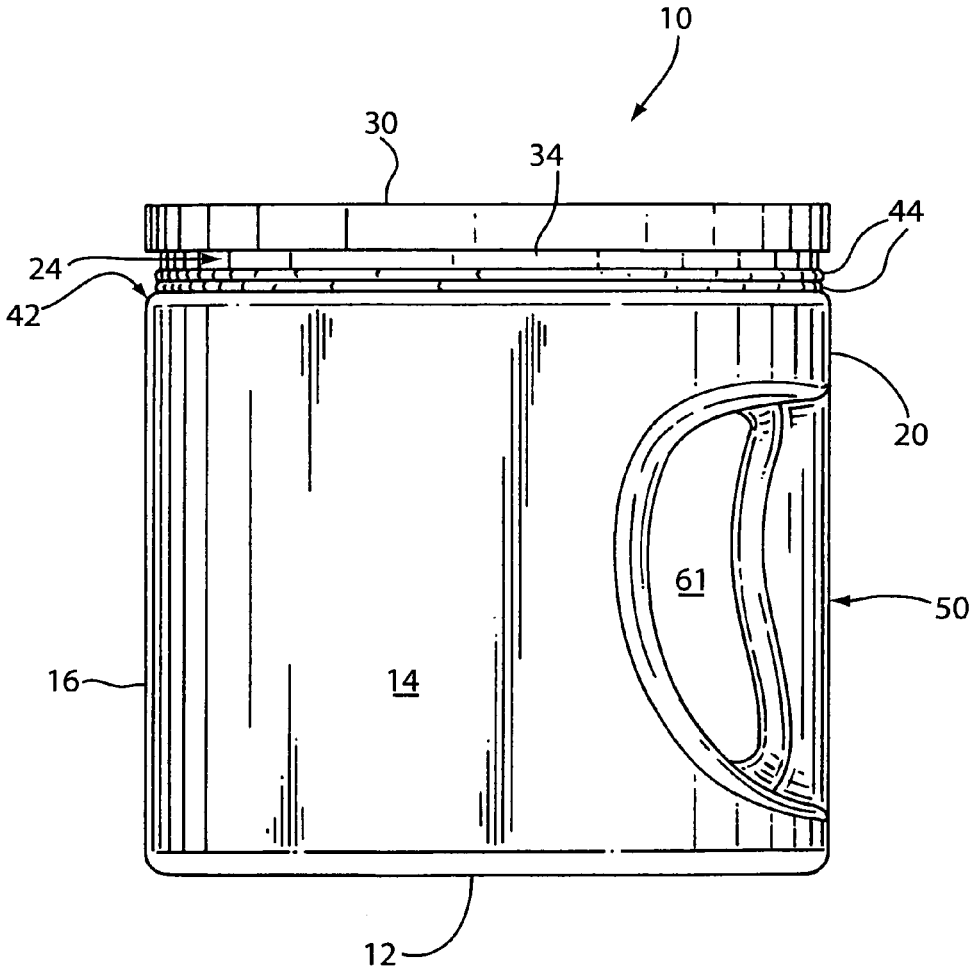
FIG. 2 is an elevation view taken in the direction of arrow A FIG. 1.
Figure 2A:
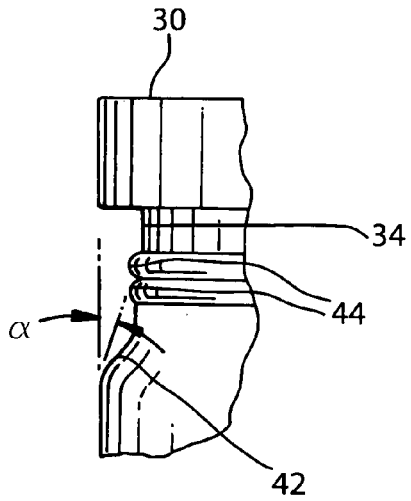
FIG. 2A is a profile view of a corner portion taken in the plane of line 2A-2A in FIG. 1.
Figure 6:
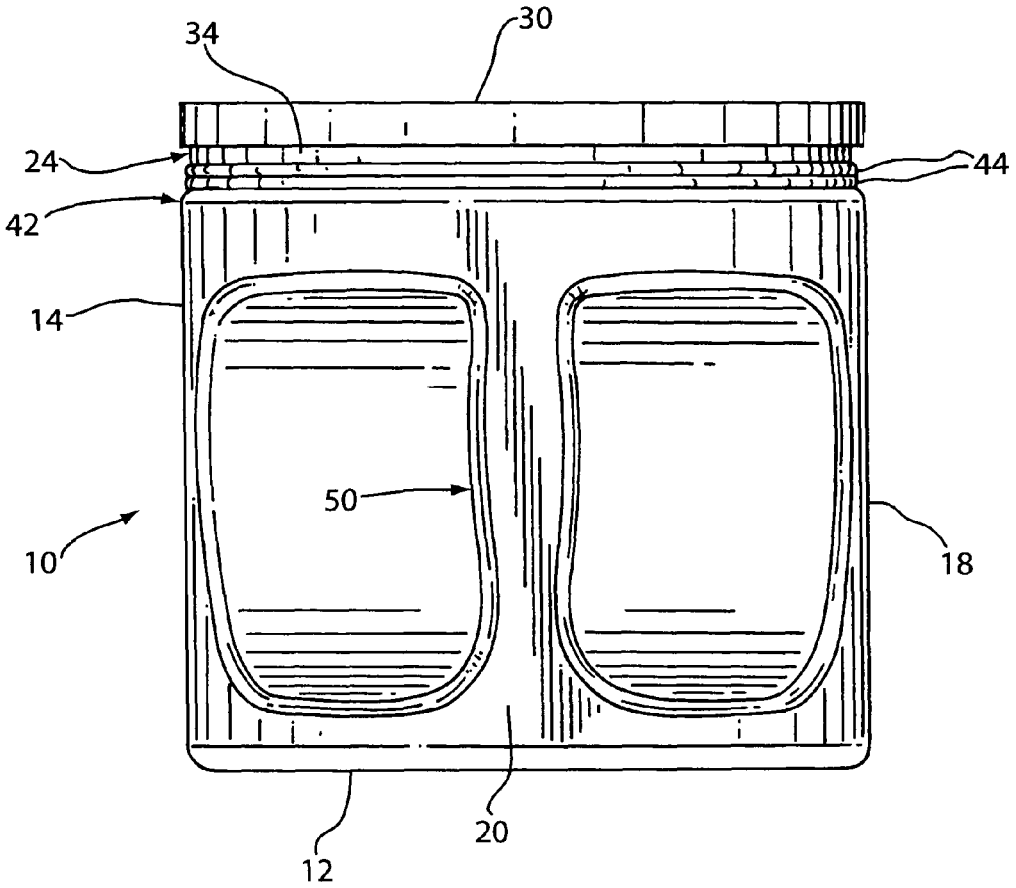
FIG. 6 is an elevation view taken in the direction of arrow C of FIG. 1.

As shown best in FIGS. 1, 2, and 6, there is a shoulder 42 between rim 34 and each side 14, 16, 18 and 20. In this embodiment, shoulder 42 is very short in the middle section of each side 14, 16, 18 and 20, and has a maximum length at the corners such as shown in FIG. 2A. At the maximum length, it will be appreciated that shoulder 42 forms an angle a from vertical to the bead where shoulder 42 ends which angle $\alpha$ is less than 40° to provide a strong load bearing capability for top 24. Shoulder 42 is located below two convex beads 44 defining the lower part of rim 34. Beads 44 serve as a further reinforcement mechanism for rim 34 above shoulder 42 to reinforce the strength of rim 34 when a load is applied to top 24, such as by stacking one or more similar containers 10 thereupon as would typically occur during shipping and storage.

The provision and noted orientation of shoulder 42 serves to significantly increase the top load strength of container 10 relative to prior art containers in view of the amount of material used in container 10, termed "design effectiveness". In top load tests performed with a container of the present invention and available prior art containers, where a force is evenly distributed to a container top having no lid under the conditions of room temperature and pressure and with nothing in the container, the following results were obtained:

| CONTAINER | TOP LOAD-Lbs | WEIGHT-Grams | VOLUME-Liters | EFFECTIVE-NESS |
|---|---|---|---|---|
| HILLS BROS.[1] | 281 | 212 | 3.044 | 4.03 |
| HILLS BROS.[1] | 166 | 184 | 3.044 | 2.74 |
| DUTCH BOY[2] | 205 | 230 | 4.218 | 3.75 |
| Invention | 350 | 128 | 2.874 | 7.85 |

[1]Plastic containers with 39 oz. of coffee packaged therein, a SARAH LEE product.
[2]A plastic container with one gallon of DUTCH BOY paint therein.

where top load is the maximum force sustained; and where design effectiveness is defined as (top load)×(volume)/(weight).

Design effectiveness is thus a measure of strength as a function of the volume and the amount of material needed to create that volume—which material for all containers was primarily high density polyethylene (HDPE). It will thus be seen that the present invention provides a superior design effectiveness compared to the presently available containers which were tested. While the preferred embodiment has a design effectiveness of 7.85 as indicated above, it is considered that a design effectiveness of at least about 5.0 is satisfactory to effect the advantages of the present invention.

To assist in any desired stacking of containers 10, it will also be appreciated that base 12 and lid 30 of container 10 are generally flat. However, base 12 and lid 30 are designed to have some stacking mechanism or interlocking (not shown) therebetween so that two stacked containers 10 will not have much play therebetween when stacked. For example, base 12 may have a raised platform or like concavity inside the perimeter thereof so as to create four short feet of the base, so that during stacking the four feet would receive therebetween or nest with the lid 30 of an underlying container. Other such stacking mechanisms are well known in the art, so that any other suitable prior art stacking mechanism could be used as desired.

Figure 2B:
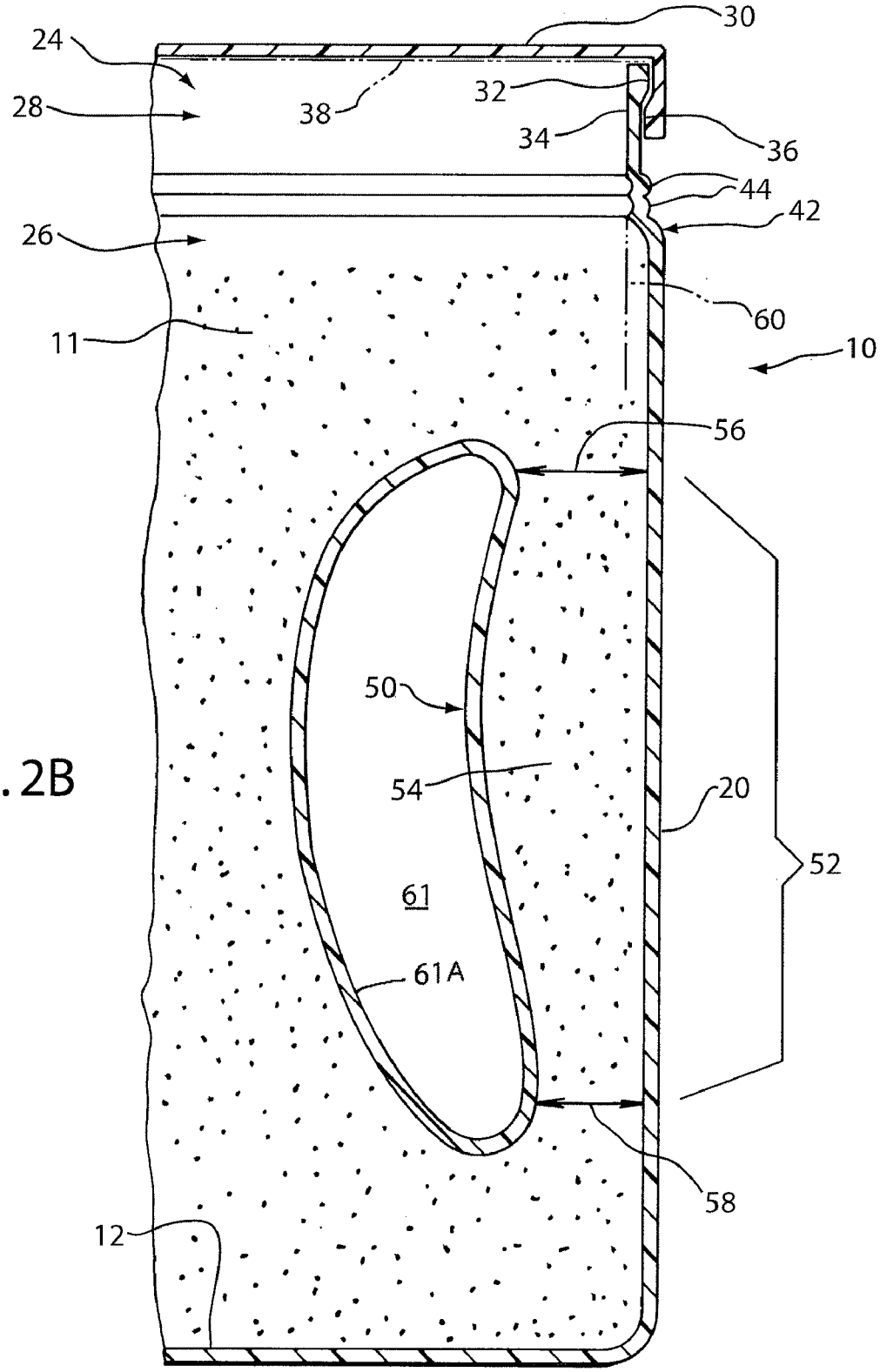
FIG. 2B is a partial cross sectional view taken in the plane of line 2B-2B of FIG. 1.

As also shown best in FIGS. 1, 2, and 6, there is a pass-through handle 50 provided in one side of container 10, in this embodiment the right side 20. This position of handle 50 makes it easy for a user to see handle 50 as it is sitting on a shelf or the like from which the user will remove container 10 for purchase or use. Handle 50 includes a generally vertical segment 52 (see FIG. 2B) which defines a hollow cavity 54 therein. It will be appreciated that cavity 54 is in communication with main interior volume 26 at both a top end 56 before the top transition segment of handle 50 and a bottom end 58 before the bottom transition segment of handle 50 as shown in FIG. 2B; though if desired this hollow cavity could be closed off or formed as a solid or filled. It will also be appreciated that opening 28 extends over a portion of cavity 54, as shown by broken line 60 which extends down from opening 28 is FIG. 2B. Handle 50 is considered "pass-through" since when handle 50 is gripped by a user, the fingers of the user will pass between the remainder of right side 20 and handle 50, which pass through region is thus considered as an opening 61. As illustrated, for example in FIGS. 1 and 2B, the interior wall 61A of opening 61, while curved in the vertical direction, extends horizontally along its width in substantially straight lines from side 14 to side 18, and thus may be referred to as a substantially straight wall.

By use of the pass through or opening 61, handle 50 is easily and securely gripped by the hand of the user. The outside of handle 50 is generally straight to fit within the square footprint of container 10, but the inside is somewhat convex to make it easier to grip and hold container 10. In addition, it will be appreciated that opening 61 terminates vertically upward so that the upper portion of the hand of the user gripping handle 50 will rest directly against the upper end of opening 61 for easier holding and support of container 10. Further, the lateral sides of handle 50 are slightly convexly curved as shown in FIG. 6, to provide a comfortable handle 50, as well as to facilitate the molding thereof. Still further, it will be appreciated that handle 50 starts a short distance above base 12, which also facilitates the blow-molding thereof, while still affording sufficient length for handle 50. As handle 50 is probably the most difficult part of container 10 to form effectively in the blow molding process, the configuration and transitions thereof are important in producing a satisfactory blow molded container.

It has been found that it is easier for most users to grip handle 50 when handle 50 is at least about 2.5 inches in length and preferably about 2.75 inches, as this affords a sufficient length for almost everyone's hand to surround. In addition, handle 50 is also easier to grip by most users when the width (parallel to side 20) thereof is equal to or slightly above about 1 inch, and the thickness is equal to or slightly below about 1 inch, so that the ratio of width to thickness falls in the range of about 1.0 to 1.2. In the preferred embodiment, the width is about 1.09 inches and the thickness is about 0.96 inches, for a ratio of about 1.09. Also in the preferred embodiment, the height of handle 50 is preferably about 45-55% of the total height of container 10. This percentage of height provides an easily gripped and manipulated handle relative to the overall size/height of container 10.

It will be appreciated that "pass-through" handle 50 is preferred over a more easily formed "pinch" handle for a container which houses a particulate such as coffee 11. One advantage of pass-through handle 50 is that it can be encircled by the hand of the user; while a pinch handle would include only opposed indentations in a side so that the pinch handle would have to be pinched between the thumb and fingers of the user requiring significant friction and thus being more difficult to hold—especially as container 10 may house four pounds or more of particulate coffee or the like. Another advantage of pass-through handle 50 is that the hand (palm) is closer to the handle and will do most of the supporting. Thus, with a pass-through handle 50, there will be a reduced moment on the wrist (due to the smaller moment arm) than with a pinch handle where the wrist will be further away from the handle and in addition the weight must be supported by thumb/fingers against slippage. Further, by use of pass-through handle 50, slippage is prevented by the upper end of the pass-through opening being engaged in a normal grip with no squeezing required. In view of these advantages, it is believed that a user will be able to hold about 60-70% more weight in a container with a pass-through handle as compared to a container with a pinch handle. Thus, from an ergonomics viewpoint, the pass-through handle is considered superior to a pinch handle for a particulate container—especially for those with smaller/weaker wrists.

If desired and as appropriate, container labels or like information can be applied to sides 14, 16 and 18 over as much or little of the area thereof as required. In addition, a label or labels could also be provided on right side 20 along the flat areas thereof as well. In use, it is anticipated that right side 20 containing handle 50 will generally be displayed or used so that the handle thereof can be easily grasped from the right thereof, in which case front side 14 will be facing the user and be the primary side for display of a label especially while being displayed for purchase.

Figure 7:
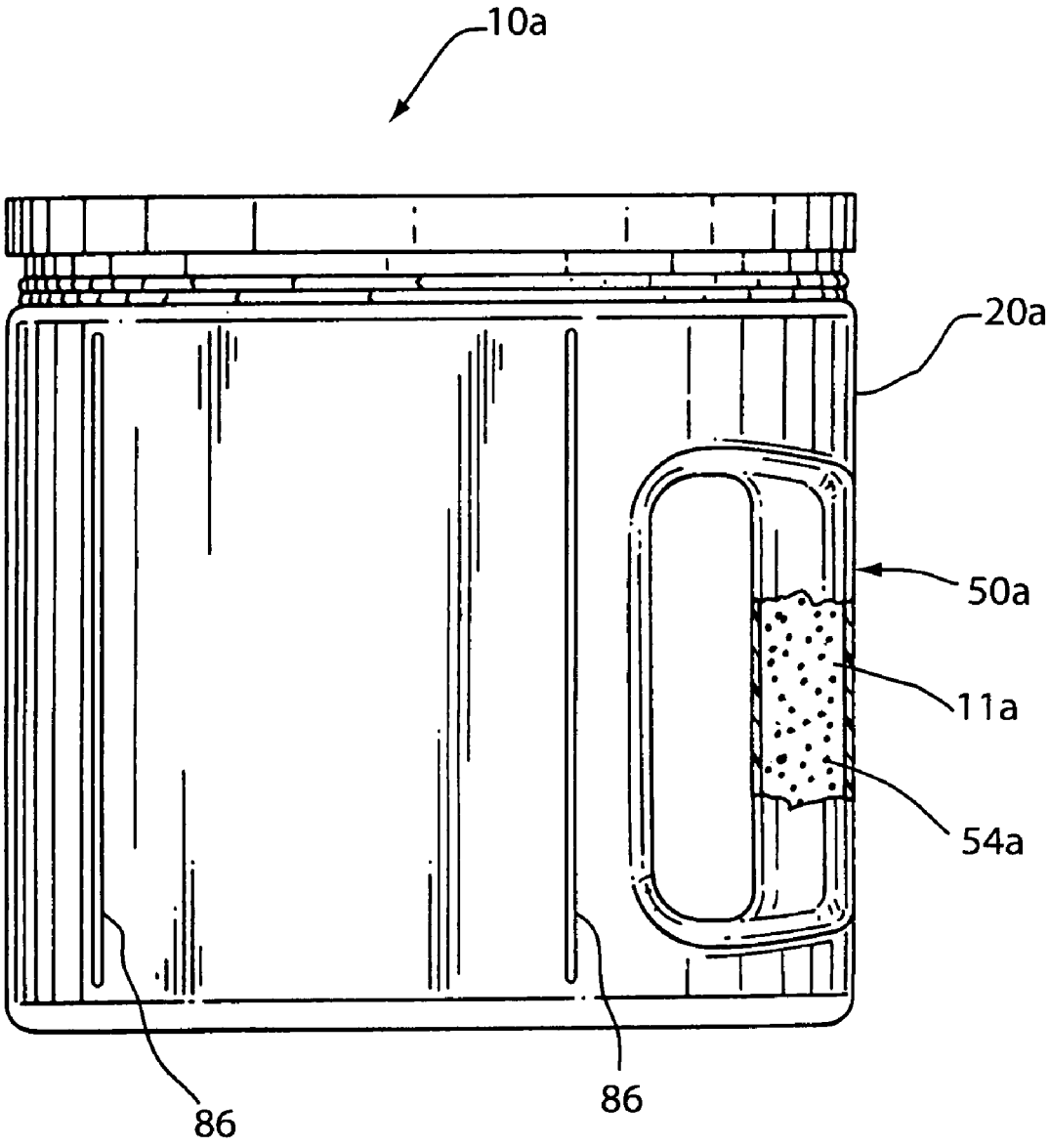
FIG. 7 is an elevation view similar to FIG. 2 but showing an alternative handle and vertical reinforcing ribs for the container of FIG. 1.

FIG. 7 shows an alternative container 10*a*. Container 10*a* is generally similar to container 10 and thus similar elements when discussed will be identified with the same numbers but with an "a" added thereafter. It will thus be appreciated that container 10*a* has a pass-through handle 50*a* on right side 20*a*. Handle 50*a* has a generally flat outside just like handle 50 to fit within the square footprint of container 10*a*. However, the inside is generally flat as well for a more pleasing aesthetic appearance and simpler blow-molding operation. Alternatively, handle 50*a* could be cylindrically shaped for those portions besides the flat outside, or even including the (thus curved) outside.

It will also be appreciated that bridging may be a problem in cavity 54*a* of handle 50*a*. As appreciated by those of ordinary skill in the art, bridging of particulate materials occurs due to the tendency of particulates in a relatively narrow vertical volume to form a horizontal "bridge" across the volume rather than flowing readily to the bottom of the cavity. Thus, to prevent bridging of particulate coffee 11*a* inside of handle 50*a*, handle 50*a* and hence cavity 54*a* thereof tapers inward slightly from bottom to top along the two lateral sides thereof, so that the top end (cross section) of cavity 54*a* is slightly smaller than the bottom end (cross section). In this preferred embodiment, the taper is about 3°, which has been found to facilitate the flowing of particulate coffee 11*a* freely down cavity 54*a*.

Figure 8:
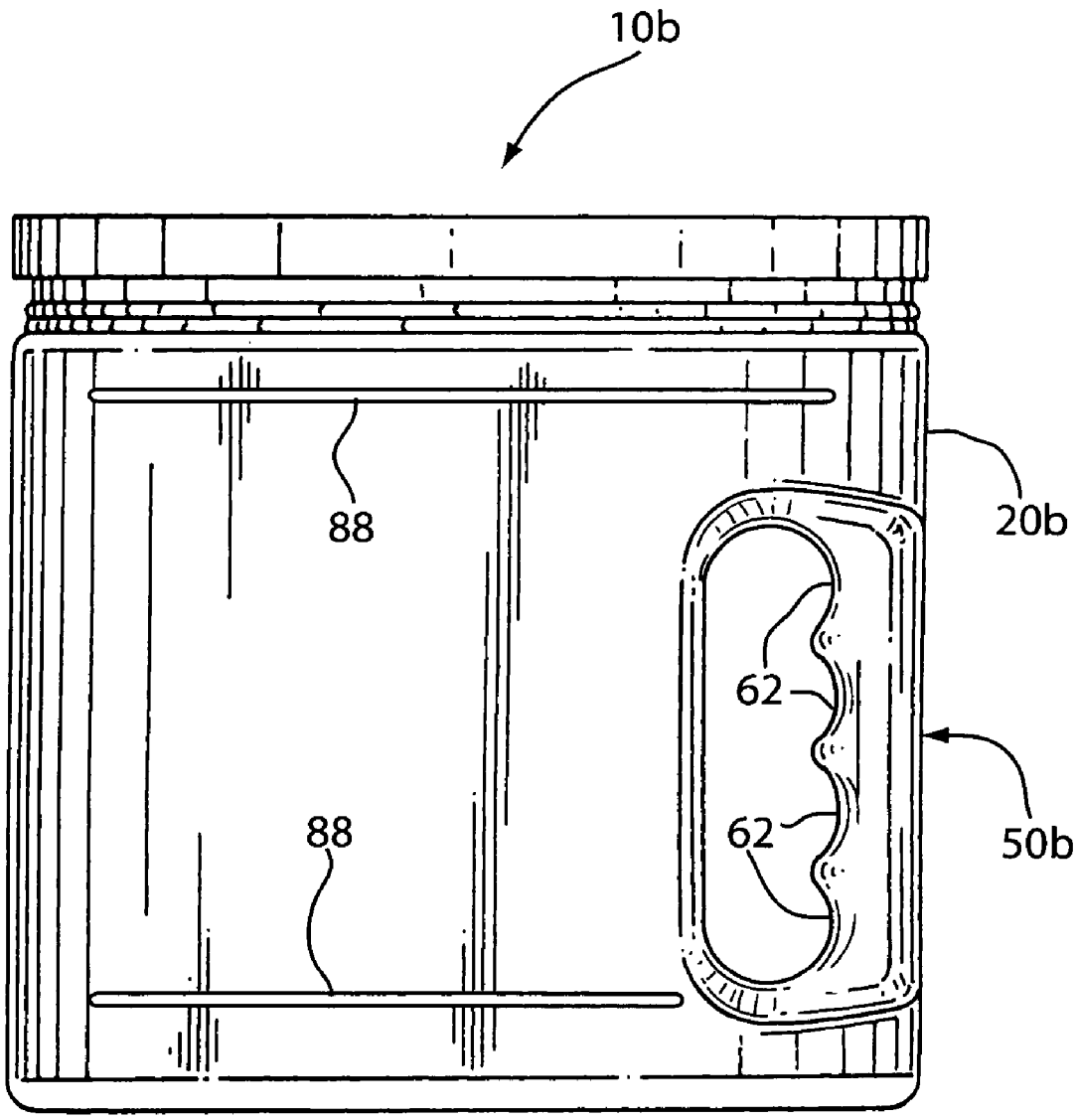
FIG. 8 is an elevation view similar to FIG. 2 but showing another alternative handle and horizontal reinforcing ribs for the container of FIG. 1.

FIG. 8 shows another alternative container 10*b*. As with similar container 10*a*, container 10*b* is generally similar to container 10 and thus similar elements when discussed will be identified with the same numbers but with a "b" added thereafter. It will thus be appreciated that container 10*b* has a pass-through handle 50*b* on right side 20*b*. Handle 50*b* has a generally flat outside just like handle 50 to fit within the square footprint of container 10*b*, but the inside of container 10*b* includes concave recesses 62 spaced vertically thereal-ong to receive the four fingers of a user when the user grasps handle 50*b*, and thus to provide a more sure and easy gripping of container 10*b* by the user.

It will also be appreciated that a container in accordance with the present invention can be provided with vertical ribs in the sides to increase top load potential, and/or horizontal ribs in the sides to help prevent side panel warping and distortion. An example of vertical ribs 86 is shown in container 10*a* of FIG. 7; while an example of horizontal ribs 88 is shown in container 10*b* of FIG. 8. Ribs 86 and 88 can be either concave as shown, or convex.

Figure 9:
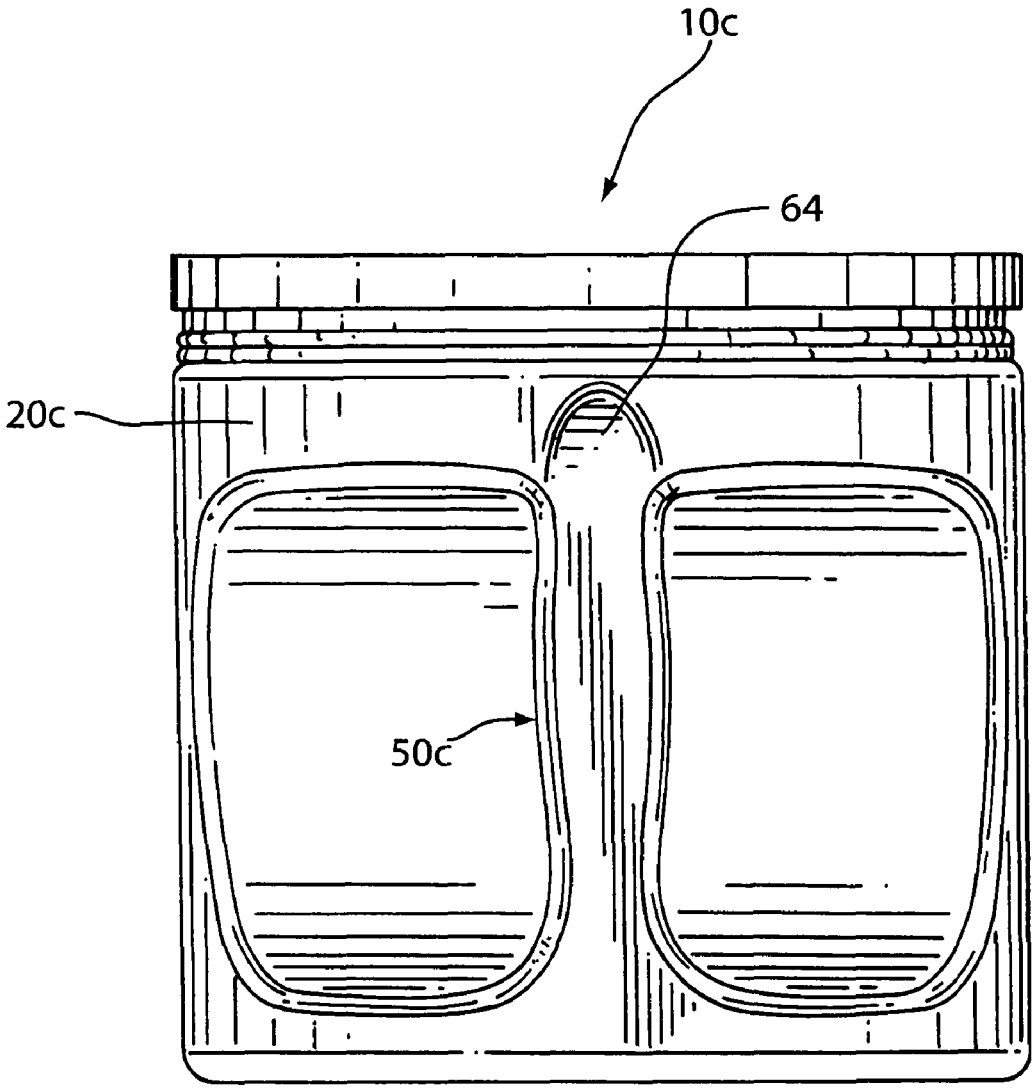
FIG. 9 is an elevation view similar to FIG. 6 but showing still another alternative handle having a thumb concavity for the container of FIG. 1.

FIG. 9 shows another alternative container 10*c*. As with similar containers 10*a* and 10*b*, container 10*c* is generally similar to container 10 and thus similar elements when discussed will be identified with the same numbers but with a "c" added thereafter. It will thus be appreciated that container 10*c* has a pass-through handle 50*c* on right side 20*c* which is substantially identical to handle 50 (and which could be identical to handles 50*a* or 50*b* as well). However, located above handle 50*c* in side 20*c* is a thumb receiving concavity 64, which as shown is deepest adjacent an upper end thereof. Thumb receiving cavity 64 serves to make container 10*c* even easier to grip, as the user can place their thumb in cavity 64 for a more secure grip of container 10*c*.

Figure 10:
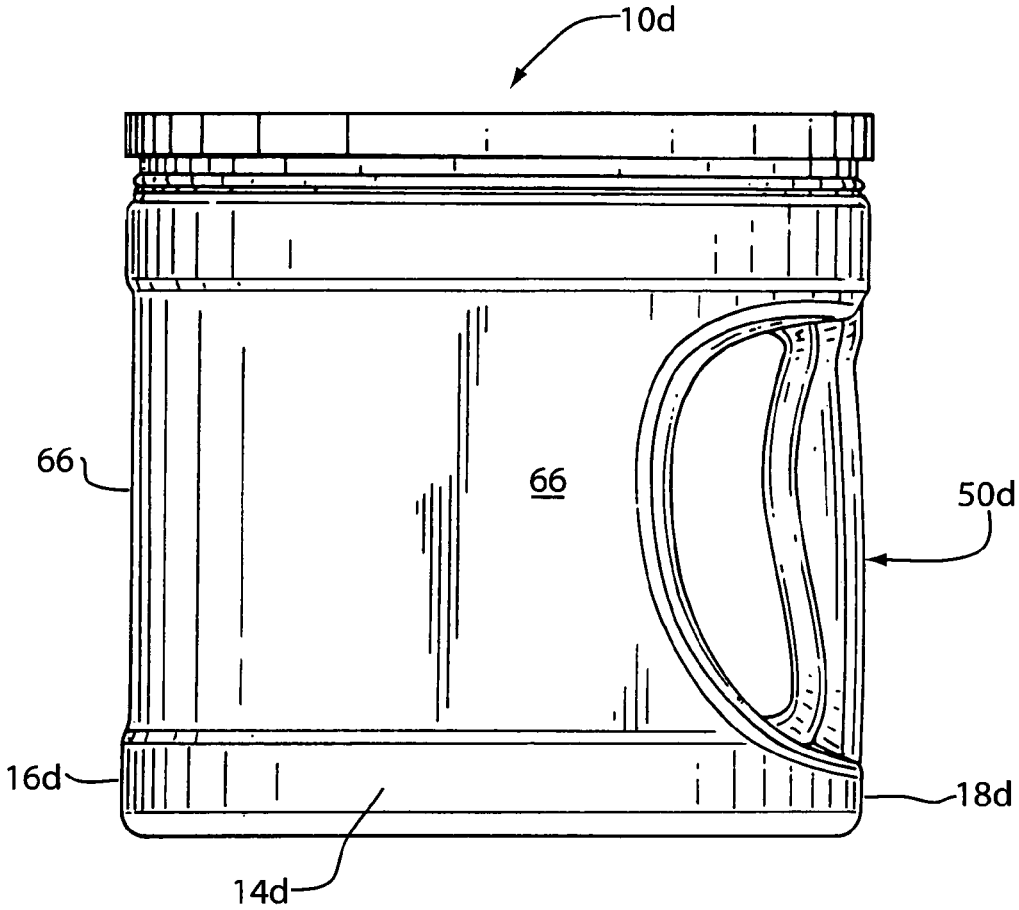
FIG. 10 is an elevation view similar to FIG. 2 but showing an alternative label receiving area for the container of FIG. 1.

FIG. 10 shows another alternative container 10*d*. As with similar containers 10*a*, 10*b* and 10*c*, container 10*d*is generally similar to container 10 and thus similar elements when discussed will be identified with the same numbers but with a "d" added thereafter. It will thus be appreciated that container 10*d* has four sides, three of which are shown as 14*d*, 16*d*, and 20*d* (the not shown side is a mirror image of side 14*d*) which have been indented to provided label receiving areas 66 thereon. Label receiving areas 66 are suitably flat and sized to adhesively or otherwise receive labels thereon. The use of label areas 66 serve to add prominence to labels, and the curved transitions to the remainder of the respective sides also serve as a strength reinforcement for the side. If desired, a single label could extend from some portion of front side 14*d* all of the way to some portion of the back side (not shown), or separate labels could be provided on the different sides.

With reference now to FIGS. 11-17, an alternative embodiment of a container 110 is depicted. Container 110 is generally similar to container 10 and/or the alternative containers 10*a*, 10*b*, 10*c*, and 10*d*discussed above, so that similar elements of container 110 will be identified with the same numbers but raised by 100. Thus, similar to container 10, container 110 includes a generally square base 112 with a front side 114, a left side 116, a back side 118 and a right side 120 extending upwardly therefrom. The transition intersections of base 112 and sides 114, 116, 118 and 120 are curved as shown for strength.

As a first major difference from container 10, it will be appreciated that right side 120 of container 110 has a generally outwardly extended or "peaked" appearance; that is, right side 120 forms an outward extension when viewed in plan (top or bottom). The appearance of right side 120 being outwardly extended horizontally away from a remainder of container 110 is the result of the corner portions of adjacent sides 114 and 118 having been moved back from right side 120 (or the generally square footprint 122 of container 110 as shown in FIG. 13), leaving the upper right and left transition portions 70 and 72 as well as the lower right and left transition portions 74 and 76 on the sides of a handle 150.

Figure 11:
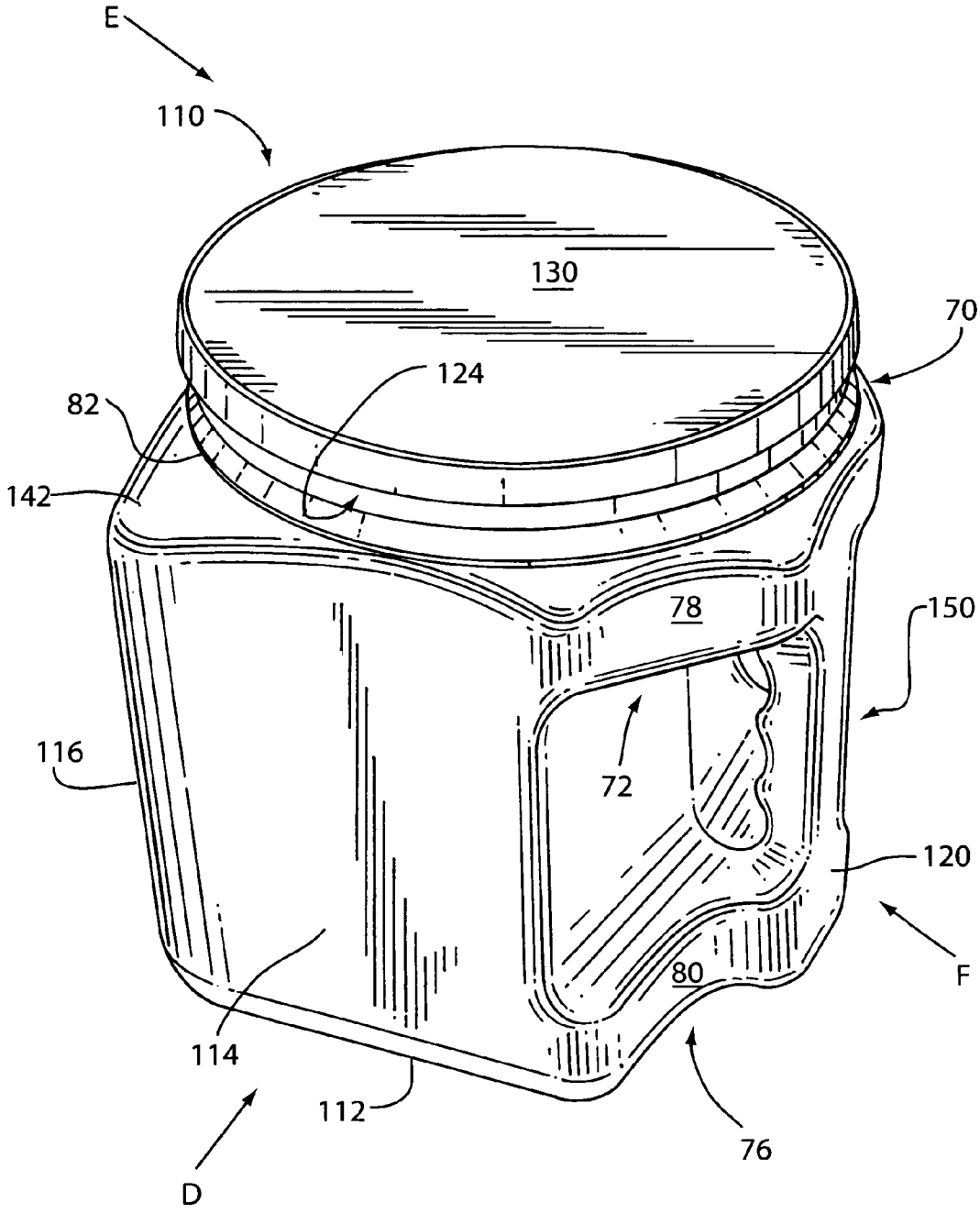
FIG. 11 is a perspective view of a another embodiment of a particulate coffee container of the present invention.
Figure 12:
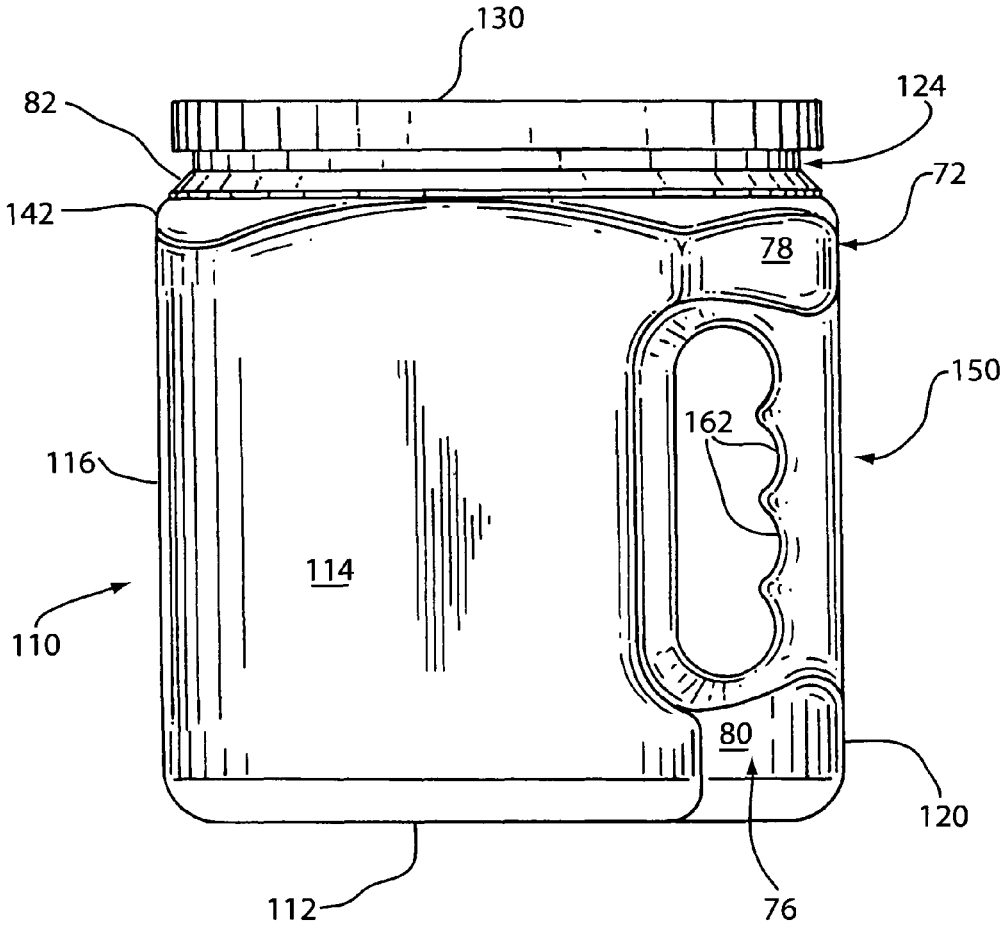
FIG. 12 is an elevation view taken in the direction of arrow D of FIG. 11.
Figure 13:
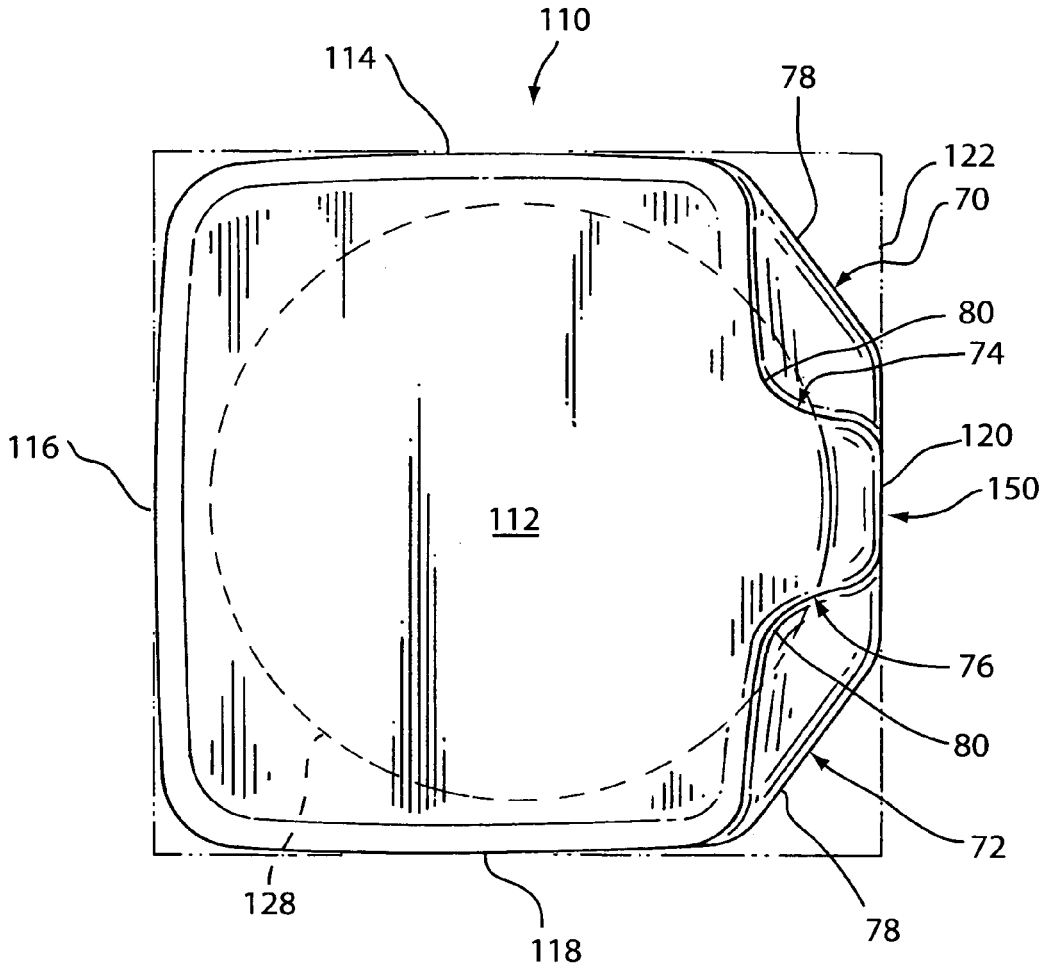
FIG. 13 is a bottom plan view of FIG. 11.
Figure 14:
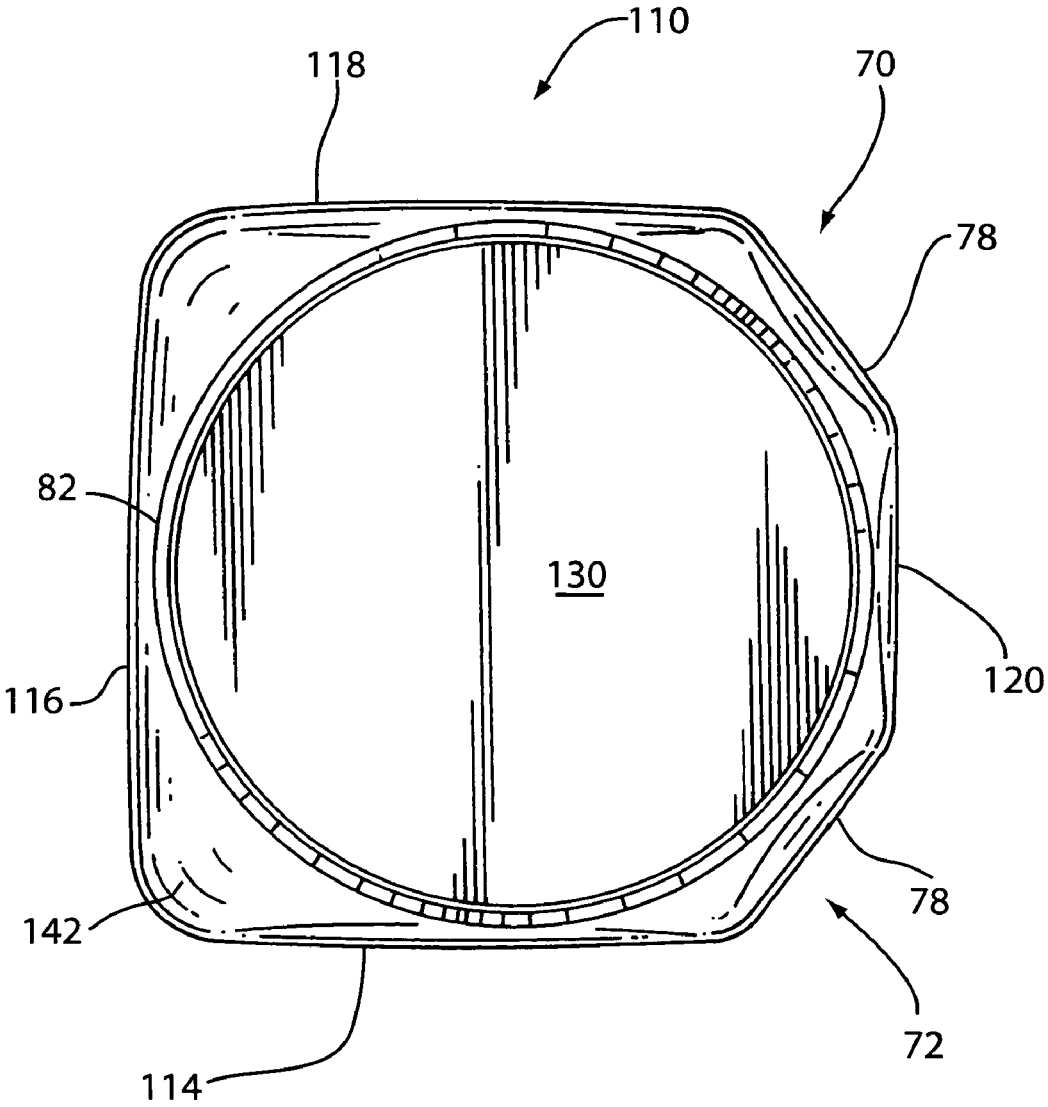
FIG. 14 is a top plan view of FIG. 11.
Figure 15:
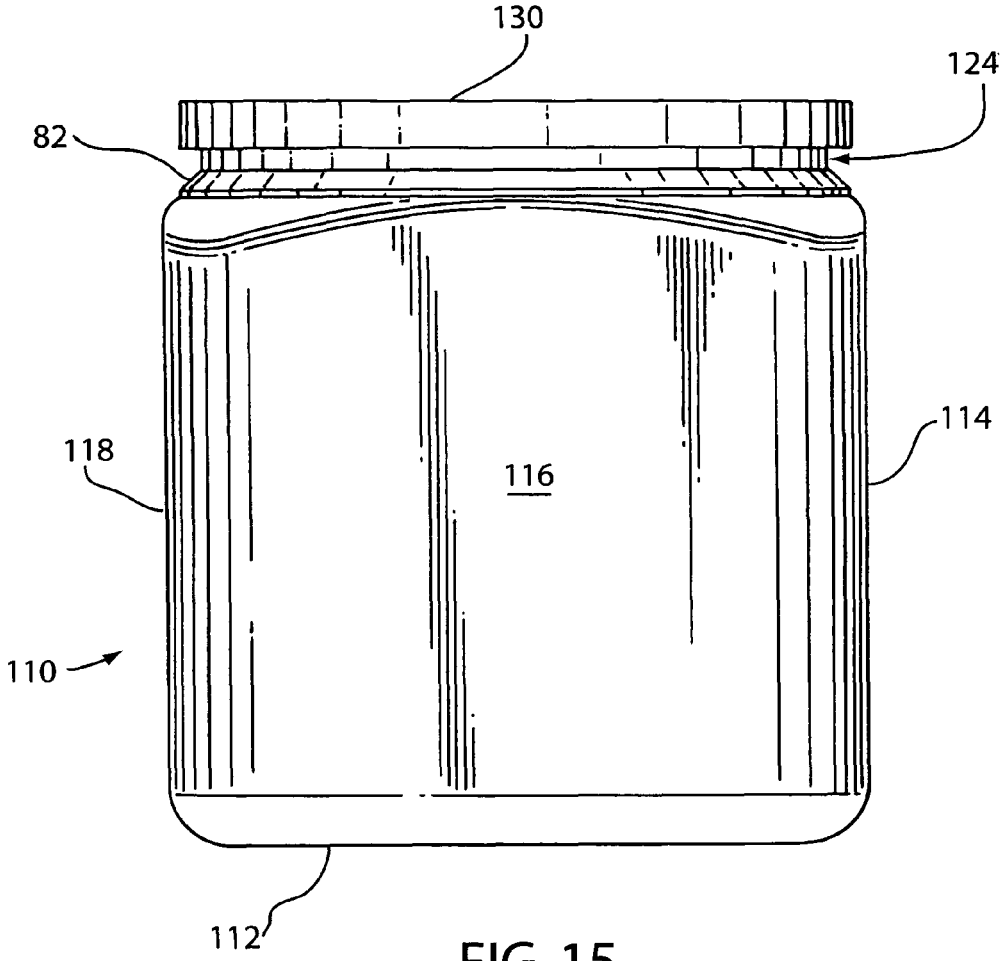
FIG. 15 is an elevation view taken in the direction of arrow E of FIG. 11.
Figure 16:
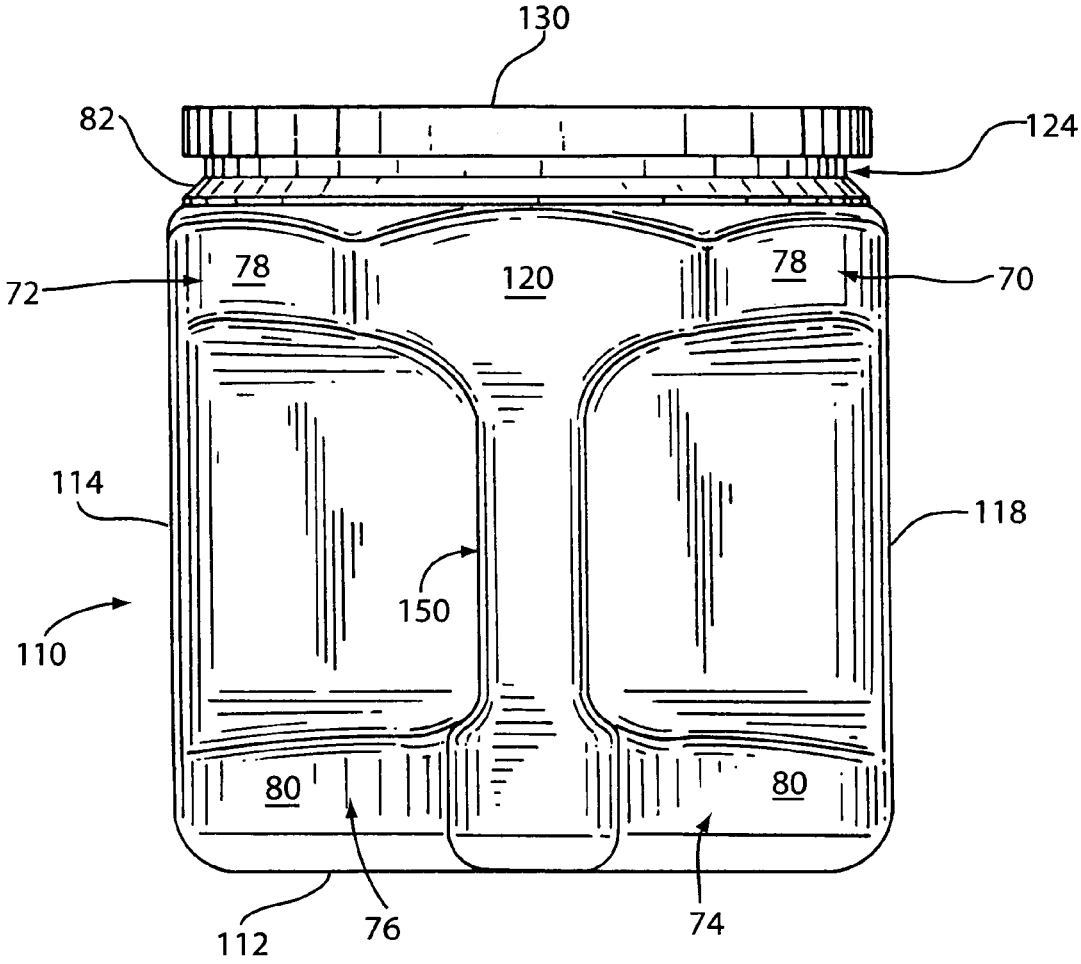
FIG. 16 is an elevation view taken in the direction of arrow F of FIG. 11.

As shown best in FIGS. 11 and 13, upper transition portions 70 and 72 are mirror images of one another and extend generally vertically and straight across from handle 150 to the adjacent side 114 or 118, with curved intersections with sides 114 and 118 and handle 150 for strength. This leaves an upper flat portion 78 of right side 120 therebetween. Similarly, lower transition portions 74 and 76 are mirror images of one another and extend generally vertically but as a curve (or vertically flat, horizontal concavity) from handle 150 to the adjacent side 114 or 118, with small oppositely curved intersections with sides 114 and 118 and handle 150 for strength. This leaves a lower curved portion 80 of right side 120 therebetween. This unique appearance is desired not only for its uniqueness but additionally since it makes the blow-molding of container 110 easier and helps to prevent a condition known as webbing which causes a stress point or weakness in the container wall.

The other major difference of container 110 from container 10 is that top 124 is connected to sides 114, 116, 118 and 120 by a collar 82 rather than beads 32. Container 110 has a large opening 128 which is circular in this embodiment, and container 110 still has the same preferred criteria for top 124 as discussed above for top 24 of container 10. Thus, top 124 is sufficiently large to permit a hand of a user to pass therethrough and scoop particulate coffee therefrom, and opening 128 is centered in footprint 122. However, collar 82 is provided as shown best in FIG. 12 to provide an added strength to the connection between top 124 and sides 114, 116, 118 and 120. For better stacking strength, shoulder 82 is provided at an angle beginning at shoulder 142 and measured from vertical of less than about 400 as seen in profile in FIG. 12.

While container 110 has been depicted with handle 150 having finger gripping concave recesses 162 similar to handle 50*b* of FIG. 8, it will be appreciated that handle 150 could also be configured similar to handle 50 of container 10 or handle 50*a* of container 10*a*. In addition, container 110 could be provided with a thumb concavity for handle 150 similar to thumb concavity 64 of container 10*c*. Further, container 110 could be provided with label receiving areas similar to label receiving areas 66 of container 10*d*.

Figure 17:
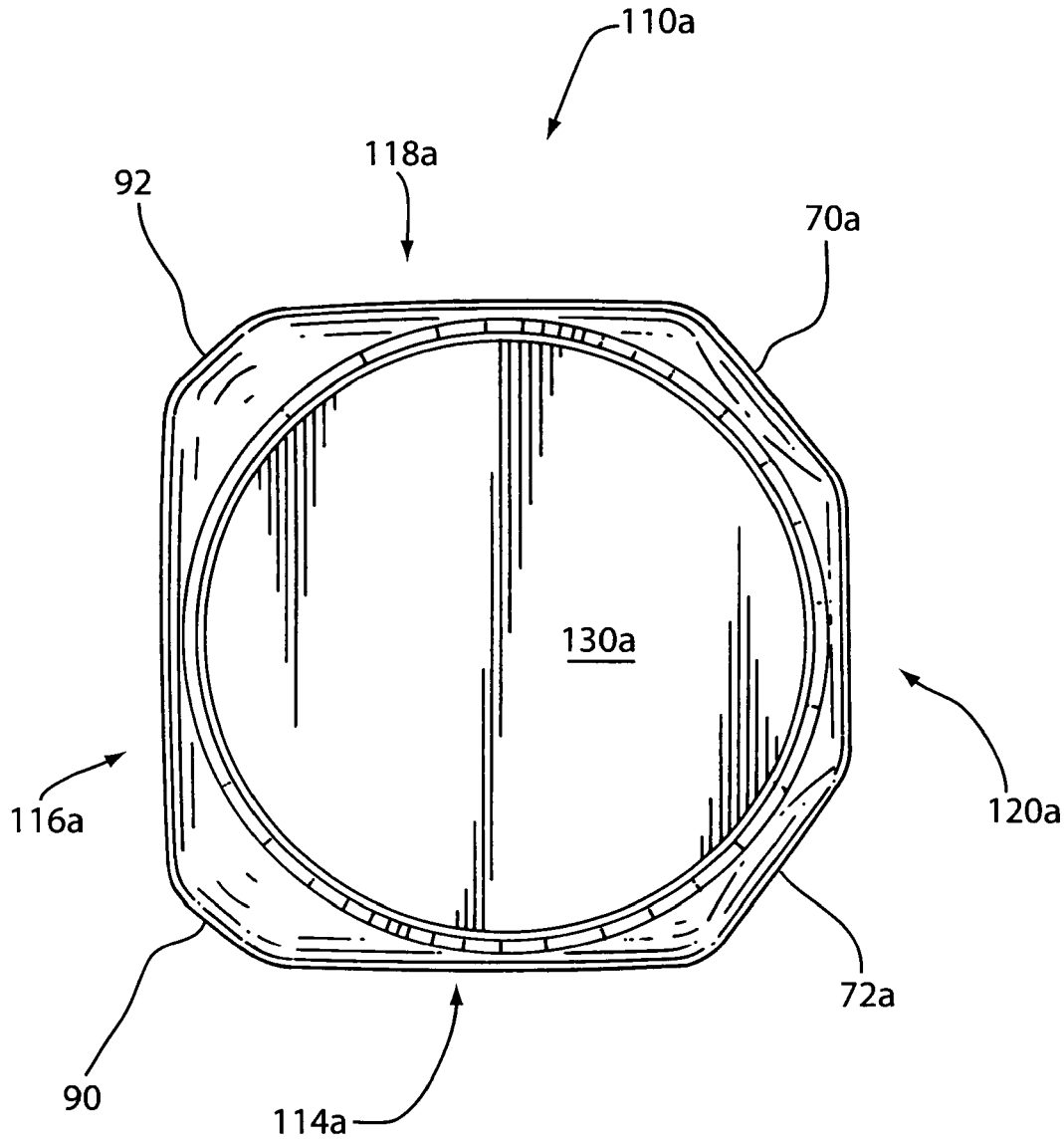
FIG. 17 is a top view similar to FIG. 14 but showing an alternative configuration for the container of FIG. 14.

FIG. 17 shows an alternative container 110*a*. Container 110*a* is generally similar to container 110 and thus similar elements when discussed will be identified with the same numbers but with an "a" added thereafter. It will thus be appreciated that container 110*a* has a front side 114*a*, a left side 116*a*, a back side 118*a* and a right side 120*a*. In addition, container 110*a* includes upper right and upper left transition portions 70*a* and 72*a*. However, rather than having curved transition portions between the left side 116 and respective front side 114 and rear side 118 as in container 110 (as shown best in FIG. 14), container 110*a* has respective front bevel (flat) transition portion 90 and rear bevel (flat) transition portion 92. It will be appreciated that bevel transition portions 90, 92 have a horizontal dimension which less than a horizontal dimension of upper right and left transition portions 70*a*, 72*a*.

Figure 18:
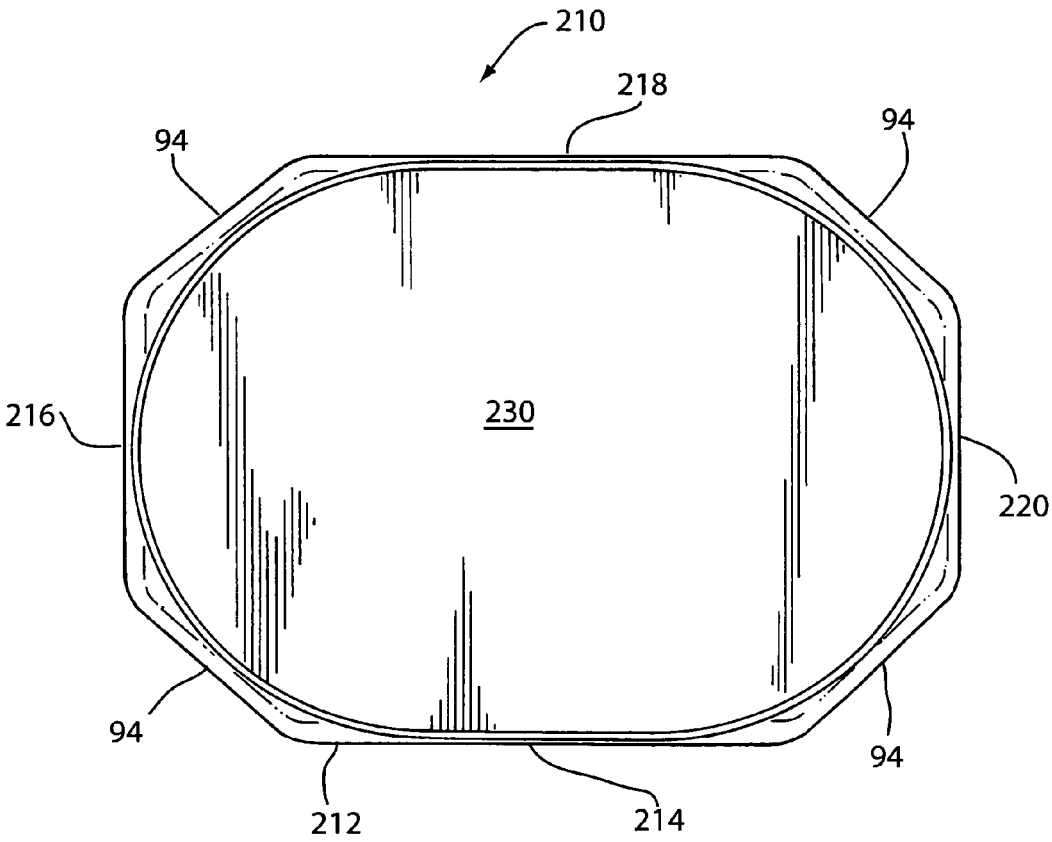
FIG. 18 is a top view of another embodiment of a particulate coffee container of the present invention.

With reference now to FIG. 18, another alternative embodiment of a container 210 is depicted. Container 210 is generally similar to container 10 and/or the alternative containers 10*a*, 10*b*, 10*c*, and 10*d* discussed above, or container 110 and/or alternative container 110*a*, so that similar elements of container 210 will be identified with the same numbers but raised by 200. Thus, similar to container 10 or container 110, container 210 includes a generally polygonal (rather than rectangular or square) base 212 with a front side 214, a left side 216, a back side 218 and a right side 220 extending upwardly therefrom. Connecting sides 214, 216, 218 and 220 are bevel transition portions 94, which are broadly similar to bevel transition portions 90, 92 discussed above (and which thus are different from the short-curved transition portions provided in the previously discussed containers). It will be appreciated that bevel transition portions 94 have a horizontal length dimension which is smaller than a horizontal length dimension of the shortest side 216, 220; but alternatively these lengths could be equal or the sides shorter than the bevel transition portions. In any event, container 210 is generally polygonal shaped, in this case with eight sides (of three different dimensions), and container 210 could also have other numbers of sides as desired (such as 6, or even 3, 5, etc. sides).

It will also be appreciated that container 210 could have a pass-through handle similar to handles 50 on any side 214, 216, 218 or 220—that is on either the long side or the short side (so that the "front" etc. designations might then have to be changed as required). In addition, container 210 could have a pass-through handle similar to handle 150 (and its variations) in a peaked side with right and left lower curved transition portions as in containers 110; and the handle could be located in either the long or short sides as well.

Figure 19:
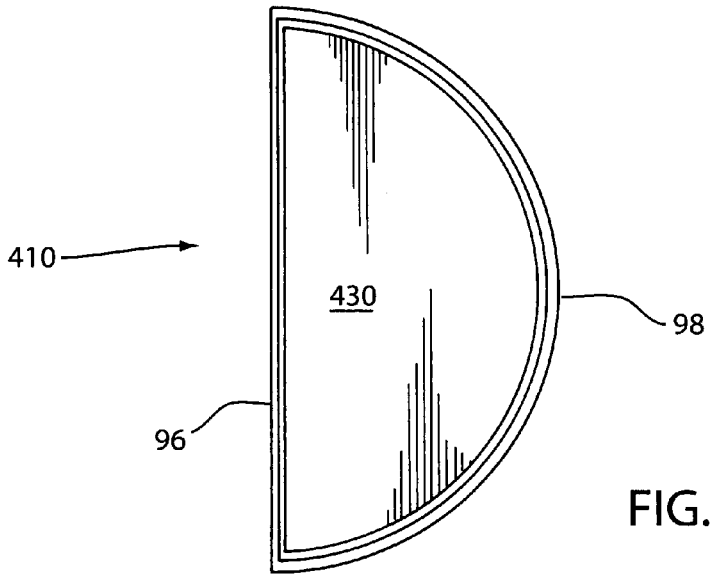
FIG. 19 is a top view of another embodiment of a particulate coffee container of the present invention.
Figure 20:
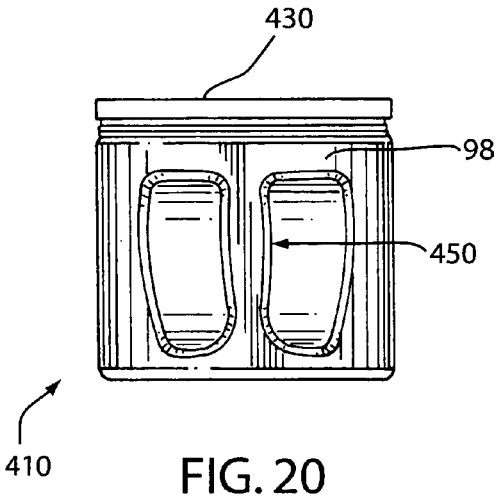
FIG. 20 is a plan view of the embodiment depicted in FIG. 19 having a handle in the semi-circular side.
Figure 21:
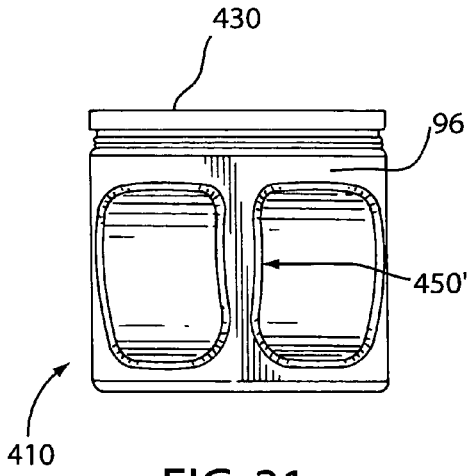
FIG. 21 is a plan view of the embodiment depicted in FIG. 19 having a handle in the flat side.

With reference now to FIG. 19, an alternative embodiment of a container 410 is depicted. Container 410 is broadly similar to containers 10, 110, 210 and 310 discussed above, so that similar elements of container 410 will be identified with the same numbers but raised by 300. The most significant difference between container 410 and the previous containers is that container 410 has only two sides, a flat side 96 and an arcuate front side which in this embodiment is a semi-circular side 98. With this construction, lid 430 is similarly semi-circular shaped as shown. It will be appreciated that container 410 can have a handle 450 in semi-circular side 98 as shown in FIG. 20; or alternatively a handle 450' in flat side 96 as shown in FIG. 21. Instead of semi-circular side 98, this could instead be two sides at an angle so that a triangular (three sided) container is provided. It will also be appreciated that handles 450 and 450' can be similar to any of the previously above-described handles.

Although the preferred embodiments of the containers have been depicted with handles which are generally centrally located horizontally along the associated side and generally offset somewhat vertically towards the base, other locations of the handles would be possible. Thus, each handle could instead be located somewhat to the left or right as desired or required; and similarly, each handle could alternatively or additionally be located vertically more toward the midway point or even offset toward the top. It would even be possible for the handle to extend almost all of the way from the top to the bottom.

It will also be appreciated that the particular features (or lack thereof of one embodiment could also be used with or incorporated into other embodiments; i.e., the various features of the embodiments are interchangeable. For example, the handle of any one embodiment could be used in place of a different handle in any of the other embodiments, or the thumb receiving cavity used with any handle, besides the ones depicted, etc. Further, an embodiment having particular features could be configured without one or more such features in the manner shown in other embodiments.

While the present invention has been described with respect to exemplary embodiments thereof, it will be understood by those of ordinary skill in the art that variations and modifications can be effected within the scope and spirit of the invention.

We claim:

1. A plastic container for a particulate product, said container comprising:

a generally square base and respective first, second, third and fourth sides upstanding from said base, the first, second and third sides being generally flat;

a top, which includes a rim, which connects with said first, second, third and fourth sides, said top including an opening therein which is large enough in diameter to allow a person's hand to pass therethrough to permit removal of the particulate product;

a shoulder extending upwardly and inwardly from the sides, said rim extending up from the top of the shoulder to the top opening, a line extending over the shoulder from the juncture of the sides and the shoulder to the top of the rim forming an angle of less than 40° with a vertical line extending up from the sides, at least at some point along said sides;

wherein the fourth side includes a pass-through handle defined interiorly by a substantially straight wall which extends horizontally in substantially straight lines from the generally flat first side to the generally flat third side, a vertical segment located outwardly from the substantially straight wall and having a width, in the direction parallel to the substantially straight wall, which is substantially less than the width of the substantially straight wall, the space between the substantially straight wall and the vertical segment forming a pass-through opening, with the distance between the substantially straight wall and the vertical segment being large enough for a portion of a person's hand to pass therethrough, and the width of the vertical segment in the horizontal direction parallel to the width of the substantially straight wall being small enough that the portion of the person's hand passing through the opening can grasp the vertical segment with the person's fingers, and wherein said top opening extends over a portion of said vertical segment.

2. A plastic container as claimed in claim 1, wherein said top opening is centered over the base.

3. A plastic container as claimed in claim 1, wherein said vertical segment has a vertical length of at least about 2.5" and a width to thickness ratio of about 1.0 to 1.2.

4. A plastic container as claimed in claim 1, wherein said vertical segment defines a hollow cavity having a top end and a bottom end, both of which are in communication with said main interior volume.

5. A plastic container as claimed in claim 4, wherein said hollow cavity of said vertical segment tapers slightly inward from the bottom to the top.

6. A plastic container as claimed in claim 5, wherein said hollow cavity tapers about 3°.

7. A plastic container as claimed in claim 1, wherein said fourth side above said handle includes a thumb receiving concavity.

8. A plastic container as claimed in claim 7, wherein said vertical segment includes vertically spaced concavities on an inwardly directed part thereof.

9. A plastic container as claimed in claim 1, wherein at least one of said first, second or third sides includes vertical ribs.

10. A plastic container as claimed in claim 1, wherein at least one of said sides includes horizontal ribs.

11. A plastic container as claimed in claim 1, wherein said container is made primarily of high density polyethylene and has a design effectiveness, defined as a maximum top load in pounds times a volume in liters both divided by a weight in grams, of at least about 5.0.

12. A plastic container as claimed in claim 1, wherein two of said sides include label receiving areas indented from a remainder of a respective said side.

13. A plastic container as claimed in claim 1, wherein said fourth side is generally outwardly extended horizontally away from adjacent said first and third sides.

14. A plastic container as claimed in claim 13, wherein said outwardly extended fourth side includes upper left and right transition portions from a top of said handle laterally to respective said first and third sides which said upper transition portions are generally vertical and flat.

15. A plastic container as claimed in claim 14, wherein said outwardly extended fourth side includes lower left and right transition portions from a top of said handle laterally to respective said first and third sides which said lower transition portions are generally vertical and concave.

16. A plastic container as claimed in claim 14, wherein said fourth side is connected to the respective said first and third sides by bevel transition portions which have a horizontal dimension less than a horizontal dimension of said upper left and right transition portions.

17. A plastic container as claimed in claim 16, wherein the horizontal dimension of said upper left and right and lower left and right transition portions are longer than the horizontal dimension of said bevel transition sides.

18. A plastic container as claimed in claim 1, wherein said first, second, third and fourth sides are horizontally connected to respective adjacent said sides by respective flat transition portions which have a horizontal dimension less than a horizontal dimension of a shortest said side.

19. A plastic container as claimed in claim 1, wherein said vertical segment is horizontally located generally midway along said fourth side.

20. A plastic container as claimed in claim 19, wherein said vertical segment is vertically located generally offset toward said base.

21. A plastic container as claimed in claim 1, further including:

an air-tight sheet which covers said top opening, and a one-way vent carried on said sheet which allows pressure within the container to be vented to atmosphere.

* * * * *

UNITED STATES PATENT AND TRADEMARK OFFICE

CERTIFICATE OF CORRECTION

PATENT NO. : 7,913,874 B2
APPLICATION NO. : 11/353091
DATED : March 29, 2011
INVENTOR(S) : Gruskin et al.

It is certified that error appears in the above-identified patent and that said Letters Patent is hereby corrected as shown below:

In column 5, line 14 please change “a” to --α--.

In column 5, lines 45 and 46, please insert as follows:

-- -where top load is the maximum force sustained; and
- where design effectiveness is defined as (top load)x(volume)/(weight).--

Signed and Sealed this
Twenty-fourth Day of May, 2011

David J. Kappos

David J. Kappos
*Director of the United States Patent and Trademark Office*